US006937194B1

(12) United States Patent
Meier et al.

(10) Patent No.: US 6,937,194 B1
(45) Date of Patent: Aug. 30, 2005

(54) CONFORMAL ELECTRONIC SCANNING ARRAY

(75) Inventors: John L. Meier, Cedar Rapids, IA (US); Martin J. Steffensmeier, Cedar Rapids, IA (US); James B. West, Cedar Rapids, IA (US); Stephen J. Wright, Azle, TX (US); Nathan O. Jensen, Cedar Rapids, IA (US)

(73) Assignee: Rockwell Collins, Cedar Rapids, IA (US)

( * ) Notice: Subject to any disclaimer, the term of this patent is extended or adjusted under 35 U.S.C. 154(b) by 168 days.

(21) Appl. No.: 10/645,244

(22) Filed: Aug. 21, 2003

(51) Int. Cl.[7] ..... H01Q 1/38
(52) U.S. Cl. ..... 343/700 MS; 343/757; 343/853
(58) Field of Search ..... 343/700 MS, 702, 343/757, 848, 853, 893

(56) References Cited

U.S. PATENT DOCUMENTS 6,388,621 B1 * 5/2002 Lynch ..... 343/700 MS
6,396,449 B1 * 5/2002 Osterhues et al. ..... 343/754
6,483,481 B1 * 11/2002 Sievenpiper et al. ..... 343/909
6,653,985 B2 * 11/2003 Sikina et al. ..... 343/853
6,670,921 B2 * 12/2003 Sievenpiper et al. . 343/700 MS

OTHER PUBLICATIONS

"Optically Transparent Patch Antennas", John H. Glenn Research Center, Cleveland, Ohio [online], [retrieved on Apr. 2, 2001]. Retrieved from the Internet: <URL: http://www.nasatech.com/Briefs/Dec99/LEW16574.htm>.

"Optically Transparent Patch Antennas", Technical Support Package, NASA Tech Briefs LEW–16574, John H. Glenn Research Center, Cleveland, Ohio, Dec. 1999.

* cited by examiner

*Primary Examiner*—Shih-Chao Chen
(74) *Attorney, Agent, or Firm*—Nathan O. Jensen; Kyle Eppele

(57) ABSTRACT

A method of forming a conformal electronic scanning array (ESA) is disclosed. The ESA is formed using rolling techniques similar to those used in forming LCD displays. If the layers forming the ESA are made of substantially transparent materials, the ESA may be applied to an outer surface of a display, such as a flexible display. The ESA may also be applied to a window or other non-planar surface such as an outer surface of a vehicle, or may be integrated into a computer display.

20 Claims, 7 Drawing Sheets

CONFORMAL ELECTRONIC SCANNING ARRAY

FIELD OF THE INVENTION

The invention relates to communication devices and methods of manufacturing communication devices. More particularly, the invention relates to integrated electronic scanning arrays (ESA) and methods of manufacturing the same.

BACKGROUND OF THE INVENTION

Communication systems have been developed for a wide variety of different applications. For example, communication systems employed on an aircraft include in-flight operations systems such as global broadcast systems (GBS) and in-flight entertainment (IFE) systems that supply television and Internet to aircraft passengers. Wireless IFE systems display video and data information received from low power signals. Accordingly, some IFE systems include liquid crystal display (LCD) systems as well as antennas.

One type of antenna which can be used in communication systems is an electronic scanning array (ESA). An ESA typically includes many small antenna elements which, when correctly phased using electric circuits, form electromagnetic beams of radio waves for transmission or reception.

Traditionally, ESAs have not been widely used because they are inherently very costly to make. For example, an ESA for a single IFE passenger unit can cost over $10,000 to manufacture. More precise ESA systems cost over $1 Million to manufacture. Larger arrays require heavy support structures and complicated manufacturing procedures.

In addition to cost issues, another important design limitation for conventional systems is the volume needed to have both a display and an antenna co-located. Many applications, including in-flight systems, laptop computers, handheld devices, and other communication devices, are limited in the amount of space available for a display, an antenna, and other electrical components. For example, a handheld device used by a soldier or a hiker should be as compact as possible. Separate display, receiver, and many antenna elements would be unwieldy for such a handheld device.

In the area of GBS, global positioning systems (GPS), and other satellitebased systems, however, it is not known to integrate the display, a portion of the receiver, and antenna in a small form factor. Furthermore, although it has been suggested to use a flexible display that can be conveniently stored in a pocket, users of satellite-based systems also require a portable satellite antenna as well as a receiver. In other applications, such as airborne or vehicle-mounted applications, larger antennas may be used, but space considerations often preclude the use of larger antennas. In addition, such larger antennas may impair a mobile platform's performance by adding drag to an aircraft on which the antenna is mounted.

It is therefore an object of the invention to manufacture electronic scanning arrays (ESA) in a less expensive manner.

It is another objective of the invention to provide an antenna which can be integrated as part of the display.

A feature of the invention is a transparent, flexible electronic scanning array that may be integrated into a display during the manufacturing of the display.

Another feature of the invention is embedding an antenna in a flexible display, thereby combining a display, receiver, and antenna into a single light, portable flexible display.

An advantage of the invention is that a large ESA may be inexpensively manufactured and used on a mobile platform, such as an aircraft, without degrading aircraft performance due to drag associated with radomes.

SUMMARY OF THE INVENTION

The invention provides a method of forming a conformal electronic scanning array. According to the method, a plurality of receptor structures are established in a substrate. A first conductive passage is created through the substrate and is associated with each receptor structure. A plurality of transmit/receive circuitry units are applied to a surface of the substrate such that each of a substantial portion of the receptor structures are filled by a transmit/receive circuitry unit disposed therein, and a first electrical contact on each transmit/receive circuitry unit is positioned to be electrically connected with the first conductive passage. A first dielectric layer is applied to the surface of the substrate. A first conductive layer is applied to the first dielectric layer. A second dielectric layer is applied to the first conductive layer. A second conductive layer applied to the second dielectric layer and is etched to form a plurality of radiating elements. Each of the plurality of radiating elements is disposed adjacent one of the plurality of transmit/receive circuitry units such that a radiating element, a second contact on a transmit/receive circuitry unit, and the first conductive ground plane, cooperate to form an active radiating element controlled by the transmit/receive circuitry unit.

The invention also provides a conformal electronic scanning array, including a substrate having a first surface and a second surface. A plurality of receptor structures are formed in the substrate. A plurality of vias are formed in each receptor structure, through the substrate. A plurality of transmit/receive circuitry units are applied to the first conductive layer and are operative to fit into any of the plurality of receptor structures. Each of the transmit/receive circuitry units have a plurality of electrical contacts disposed thereon. Each of the transmit/receive circuitry units are configured to accommodate at least one of sending and receiving electronic communications. The plurality of vias are configured to be aligned with a corresponding number of electrical contacts disposed upon a transmit/receive circuitry unit that fits into the respective receptor structure to provide at least one of a power input and a control input thereto. An antenna element is operationally connected to the transmit/receive circuitry unit.

The invention further provides an electronics device including a display component and a conformal electronic scanning array secured to a viewable surface of the display component between the display and a viewer. The conformal electronic scanning array includes a substrate having a first surface and a second surface. A plurality of receptor structures are formed in the first surface of the substrate. A plurality of vias are formed in each receptor structure, through the substrate. A plurality of transmit/receive circuitry units are applied, in a slurry, to the first surface of the substrate and are operative to fit into any of the plurality of receptor structures, wherein each of the transmit/receive circuitry units has a plurality of electrical contacts disposed thereon. The plurality of vias are aligned with a corresponding number of electrical contacts disposed upon a transmit/receive circuitry unit when the circuitry unit is set in a receptor structure, so that the plurality of vias provide at least one of a power input and a control input to the transmit/receive circuitry unit. A first dielectric layer is applied on the transmit/receive circuitry units. A first conductive layer is applied on the first dielectric layer. A second dielectric layer is applied on the first conductive layer. A second conductive layer is applied to the dielectric layer and is etched to form a plurality of radiating elements. Each of the radiating elements is associated with an RF contact on one of the transmit/receive circuitry units to form an active radiating element therewith. The substrate, the dielectric layer and the first and second conductive layers are substantially transparent.

Other features and advantages of embodiments of the present invention will become apparent to those skilled in the art upon review of the following drawings, the detailed description, and the appended claims.

DETAILED DESCRIPTION OF THE DRAWINGS

The invention contemplates a substantially transparent, conformal electronic scanning array (ESA) that can be placed upon any number of surfaces. The ESA includes a plurality of printed or slot-type antenna elements arranged in a grid or other predetermined pattern, with associated circuitry aligned with each antenna element. As the number of antenna elements included in the conformal ESA of the present invention may number in the thousands or even millions, to ease understanding the specification and figures will principally describe the manufacture of a single antenna element. However, the invention is designed to use the disclosed methods to manufacture a conformal ESA including any feasible number of antenna elements, and the scope of the present invention should be considered to include such a conformal ESA.

FIGS. 1–12 show a method of manufacturing a conformal ESA according to an embodiment of the invention. As will be seen, each component of the conformal ESA is applied layer by layer using rolling, sputtering, and etching techniques similar to known processes used to manufacture LCD display systems, with special care to observe known RF fabrication design rules. The method as disclosed herein will describe each layer or component being applied on or to a previously disclosed component. It will be understood that such application is performed on the open surface of a previously disclosed component or layer, which as shown in the Figures may correspond to either the upper open surface or the lower open surface of said component or layer. It will be further understood that the thicknesses of the several layers as depicted in the Figures are not necessarily representative of the true thicknesses of said layers. However, the thicknesses of various layers will affect performance of the conformal ESA.

Figure 1:
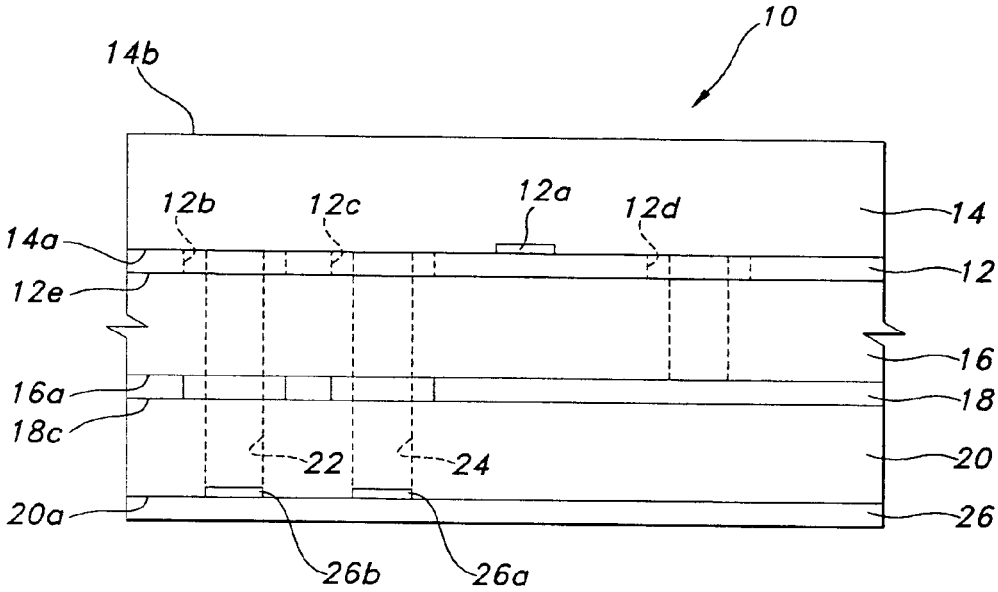
FIG. 1 is a side elevational view showing a single element of a conformal electronic scanning array, in cross-section, during manufacture.
Figure 2:
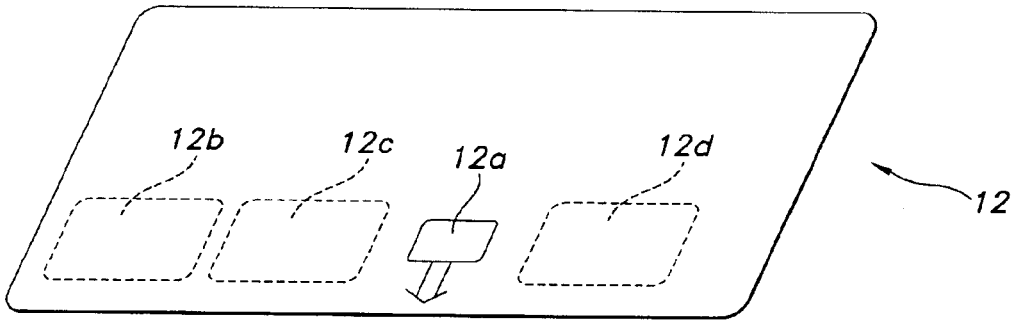
FIG. 2 is a perspective view of a portion of a manifold layer shown in FIG. 1.
Figure 3:
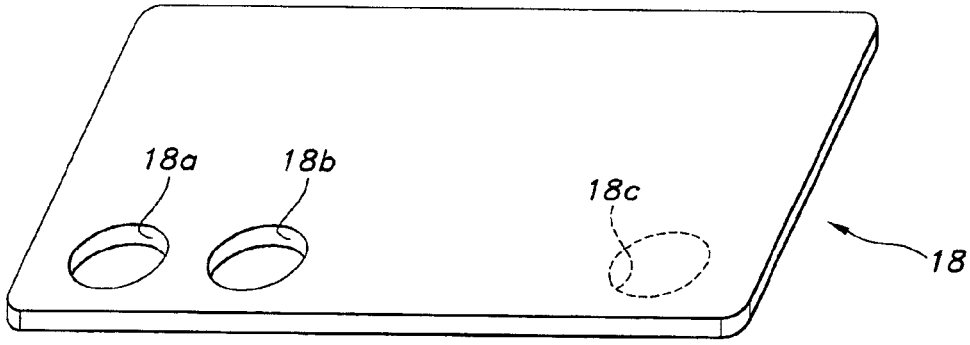
FIG. 3 is a perspective view of a portion of a first ground plane layer shown in FIG. 1.

FIG. 1 depicts an ESA element 10. An RF manifold layer 12 is applied to a first surface 14*a* of a substrate or first dielectric layer 14. First dielectric layer 14 is preferably formed of a low-loss dielectric material, but may alternately be formed of an electrically mostly non-conductive substrate material, such as a semiconductor material. RF manifold layer 12 is preferably an ITO layer applied to first dielectric layer 14 according to known ITO application methods. As shown in FIG. 2, RF manifold layer 12 is etched to form an RF connection 12*a*, which serves as an RF signal output from the antenna element. RF manifold layer 12 also includes circuitry voids 12*b*, 12*c* and 12*d*, which are located such that no RF circuit elements in RF manifold layer 12 are disposed therein. A second dielectric layer 16 is applied to a lower surface 12*e* of RF manifold layer 12, and a first ground plane layer 18 is then applied to a lower surface 16*a* of second dielectric layer 16. As shown in FIG. 3, first ground plane layer 18 is preferably a thin, transparent conductive layer in which first and second holes 18*a*, 18*b* have been made prior to first ground plane 18 being applied to second dielectric layer 16. First and second holes 18*a*, 18*b* are vertically aligned with circuitry voids 12*c* and 12*b*, respectively. A third dielectric layer 20 is applied to a lower surface 18*c* of first ground plane layer 18. Third dielectric layer 20 is preferably sufficiently viscous or pliable to fill first and second holes 18*a*, 18*b* while being spread along first ground plane layer using known rolling techniques.

Figure 4:
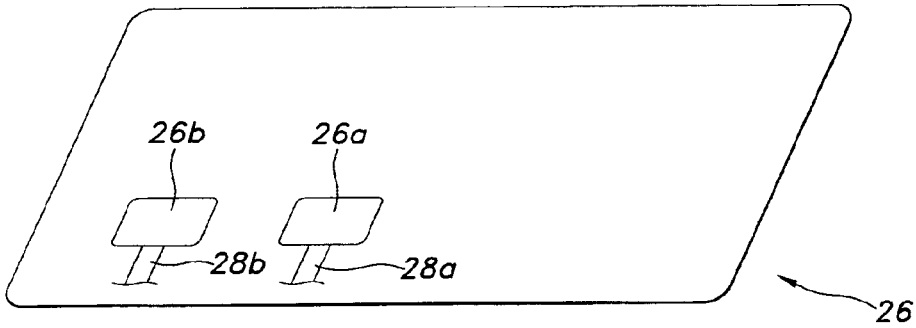
FIG. 4 is a perspective view of a portion of a power/control manifold layer shown in FIG. 1.

First and second passages or vias 22, 24 are formed, preferably using a laser or known etching processes, through third dielectric layer 20, dielectric material filling first and second holes 18*b* and 18*a*, second dielectric layer 16, and circuitry voids 12*b* and 12*c*, respectively. First and second vias 22, 24 are then preferably filled or coated with an electrically conductive substance to provide an electrical connection between the ends of the respective first and second vias. First and second vias 22, 24 are isolated from the first ground plane 18 by material from third dielectric layer 20 filling first and second holes 18*a*, 18*b*. A power/control manifold layer 26 is applied to a lower surface 20*a* of third dielectric layer 20. Power/control manifold layer 26 may be made of ITO and, as shown in FIG. 4, is etched to form a power connection 26*a* and a control connection 26*b*. Power connection 26*a* is connected, through circuitry 28*a*, to a power source (not shown) that provides a power signal to the antenna element. Control connection is connected, through circuitry 28*b*, to a control source (not shown) that provides control signals to the antenna element.

The portion of the antenna element disclosed thus far provides a series of manifolds to supply the antenna element with the required power and control signals, as well as to communicate an RF signal to or from the antenna element. These manifold layers and dielectric layers have been described as being applied to the lower surfaces (as seen in the Figures) of previously disclosed layers. Layers built upon the upper surfaces (as seen in the Figures) of previously disclosed layers will now be discussed. It is to be understood that, in accordance with known manufacturing techniques, layers may be also applied either alternatingly or simultaneously on upper and lower surfaces of previously applied layers.

Figure 5:
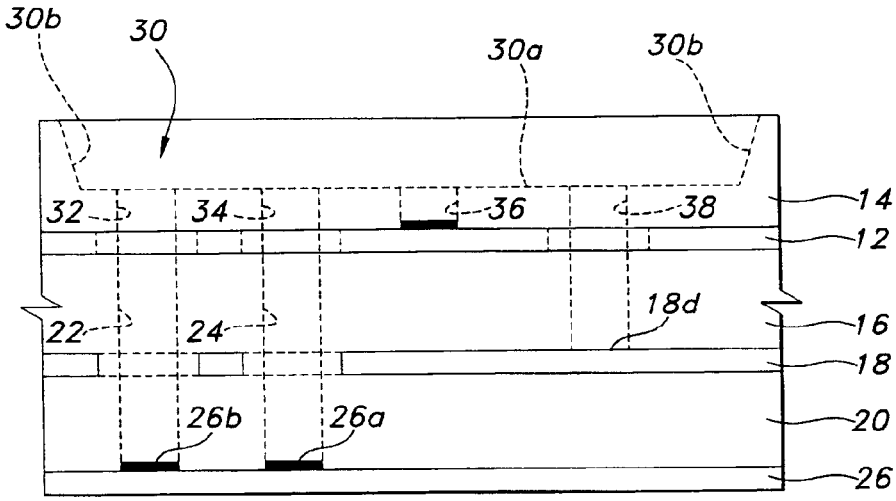
FIG. 5 is a side elevational view of the single element of the conformal electronic scanning array of FIG. 1, showing further steps of manufacture.
Figure 6:
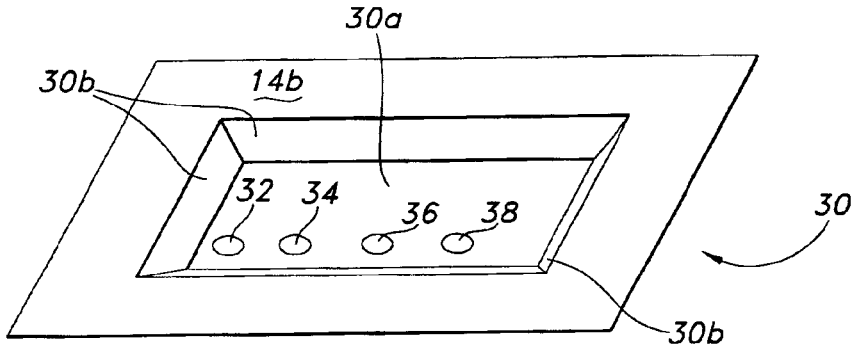
FIG. 6 is a perspective view of a receiving depression as shown in FIG. 5.

As shown in FIG. 5, a receiving depression 30 is created through second surface 14*b* of first dielectric layer 14. Receiving depression 30 is formed above connections 12*a*, 26*a* and 26*b*. FIG. 6 shows that receiving depression 30 has a unique predetermined shape, which is shown to include a generally rectangular base and angled sides 30*b* to form a generally trapezoidal crosssection. Third, fourth and fifth passages or vias 32, 34, and 36 are formed, preferably using a laser or other etching process, within receiving depression and through first dielectric layer 14. Third via 32 is formed directly over first via 22. Fourth via 34 is formed directly over second via 24. Fifth via 36 is formed directly over RF connection 12*a*. A sixth via 38 is formed within receiving depression 30 and through first dielectric layer 14, circuitry void 12*d* in RF manifold layer 12, and second dielectric layer 16 to contact first ground plane layer 18 at a contact point 18*d*. Each of the third, fourth, fifth and sixth vias are preferably filled with conductive material to provide a solid electrical connection between its two ends.

Figure 7:
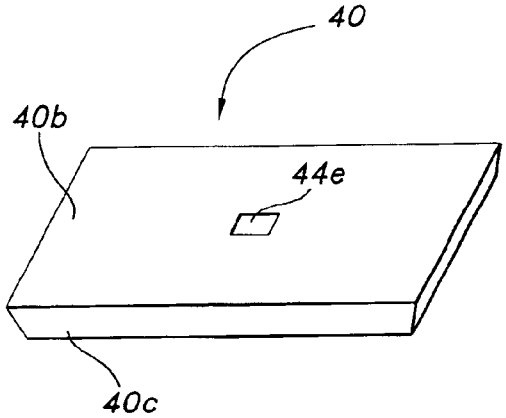
FIG. 7 is a top perspective view of a transmit/receive element used in the conformal electronic scanning array of FIGS. 1–6.
Figure 8:
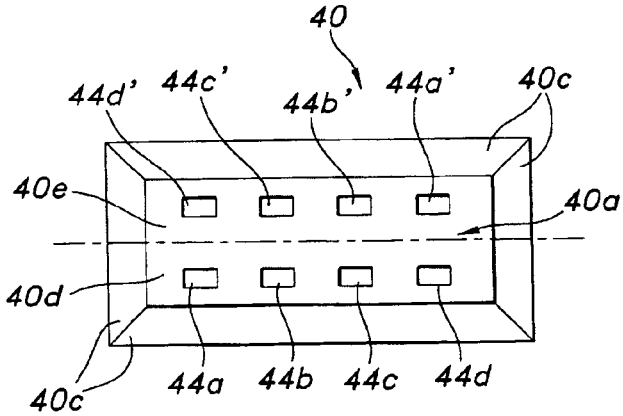
FIG. 8 is a bottom perspective view of the transmit/receive element shown in FIG. 7.

FIGS. 7 and 8 depict a transmit/receive (T/R) circuitry element or chip 40 placed within each receiving depression 30. T/R chip 40 may be configured to transmit and/or receive RF signals in conjunction with the array, but in the depicted embodiment the T/R chip is shown as being capable of both transmitting and receiving signals. T/R chip 40 has a shape complementary to the predetermined shape of receiving depression 30, including a rectangular shape and angled or chamfered sides 40*c*, so that when a plurality of T/R chips are spread along second surface 14*b* of first dielectric layer 14, each T/R chip will fit into a receiving depression as it is encountered. Specifically, the T/R chips can be most cost-effectively placed in the receiving depressions by placing the chips in a slurry and tilting the layers back and forth until the T/R chips populate a substantial proportion of the receiving depressions. This technique is similar to that used for placing LEDs in a flexible display. Other similar techniques, such as those known as fluidic self-assembly, may also be used to deposit the T/R chips in the receiving depressions. Direct-die bonding techniques may also be used to deposit and/or secure the T/R chips in the receiving depressions. The T/R chips are ensured to be properly oriented in the receiving depressions by the complementary shape of the receiving depression. It can be seen that T/R chip 40 does not sit flush within depression 30, and that a portion of the T/R chip is disposed outside of the depression.

Each T/R chip has a lower surface 40*a* and an upper surface 40*b*. Lower surface 40*a* is designed to enter receiving depression 30. As shown in FIG. 8, first through fourth electrical contacts or pads 44*a*, 44*b*, 44*c* and 44*d* are placed along a first side 40*d* of lower surface 40*a*. First contact 44*a* is aligned with third via 32 and first via 22, thereby being electrically connected to control connection 26*b* on power/control manifold layer 26 and permitting one or more control signals to be communicated therethrough. Second contact 44*b* is aligned with fourth via 34 and second via 24, thereby being electrically connected to power connection 26*a* on power/control manifold layer 26 to thereby provide a power input to T/R chip 40. Third contact 44*c* is aligned with fifth via 36, which provides a radio frequency (RF) signal connection between the T/R chip and the RF manifold. Fourth contact 44*d* is designed to provide an electrical ground for T/R chip and is aligned with sixth via 38, thereby providing an electrical ground connection between the T/R chip and first ground plane layer 18. A fifth contact 44*e* is situated on upper surface 40*b* of T/R chip 40. Fifth contact 44*e* comprises a portion of an antenna element, as will be described herein.

Even with the complementary shapes of the receiving depression and the T/R chip, the T/R chip may be inserted into the receiving depression two opposite ways. To ensure the contacts on the T/R chip will be properly connected, a set of alternate electrical contacts 44*a*', 44*b*', 44*c*', and 44*d*' are provided along a second side 40*e* of lower surface 40*a*. Altemate electrical contacts 44*a*', 44*b*', 44*c*' and 44*d*' are electrically connected to electrical contacts 44*a*, 44*b*, 44*c* and 44*d*, respectively. Regardless of the orientation in which the T/R chip is inserted into the receiving depression, the T/R chip will properly contact the electrical connections as disclosed above.

Figure 9:
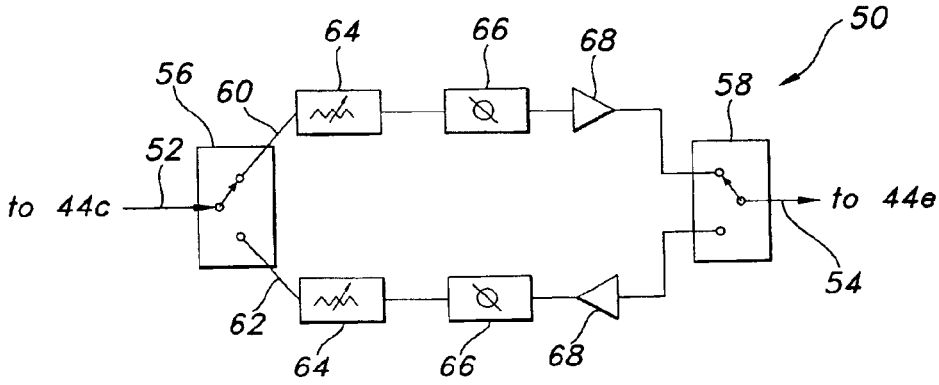
FIG. 9 is an electronic schematic diagram representative of the internal electronic structure of the transmit/receive chip shown in FIGS. 7 and 8.

An example of the circuitry that may be used in T/R chip 40 is shown in an electronic functional diagram 50 in FIG. 9. An RF input 52 is connected to third contact 44*c*. An RF output 54 is connected to fifth contact 44*e*. Switches 56 and 58 are disposed adjacent RF input 52 and RF output 54, respectively, to properly direct an RF signal through one of two electrical paths 60, 62, depending on whether an RF signal is to be sent or received. Each electrical path includes an attenuator 64, a phase shifter 66, and an amplifier 68. Other electrical components may also be included as desired. Also, the circuitry may employ common phase shifting and attenuation functions for the receive and transmit paths. The switches, attenuators, phase shifters, and amplifiers are powered by current passing through second contact 44*b*, and are controlled through control signals passing through first contact 44*a*.

Figure 10:
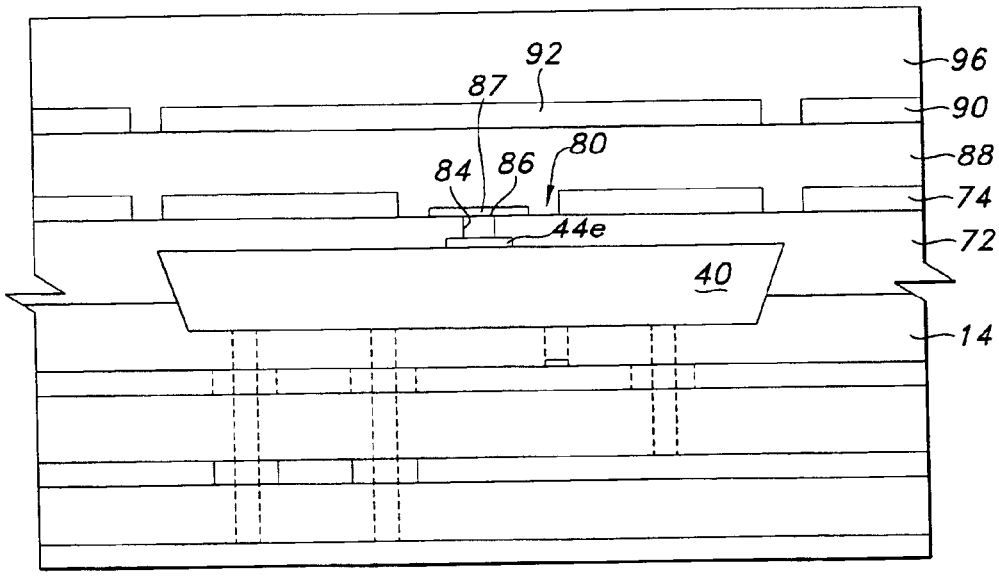
FIG. 10 is a cross-section of the single element of FIGS. 1–6 showing further steps of manufacture.
Figure 11:
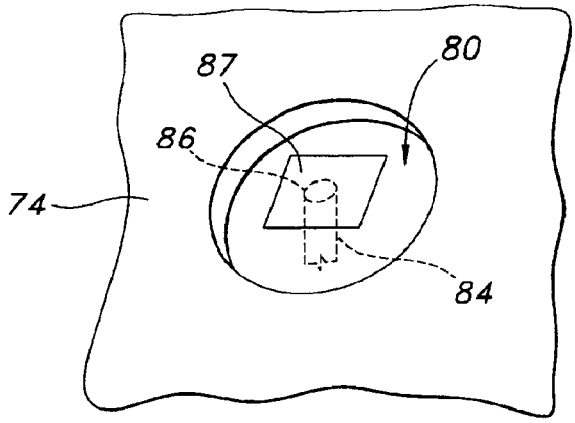
FIG. 11 is a top perspective view of a second ground plane layer shown in FIG. 10.
Figure 12:
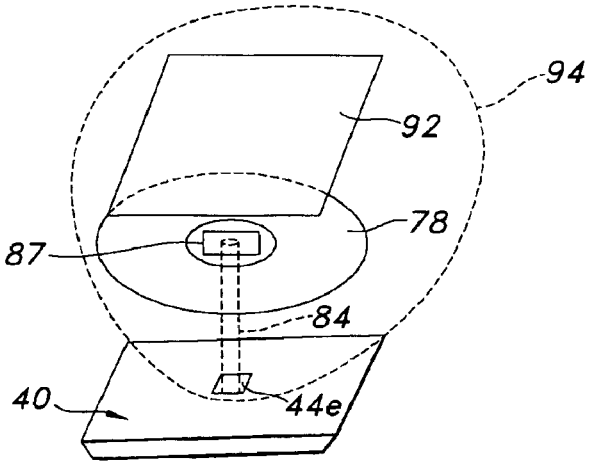
FIG. 12 is a perspective view of an electrically coupled microstrip patch antenna element according to the present invention.

As depicted in FIG. 10, a fourth dielectric layer 72 is applied to second surface 14*b* of the first conductive layer so that T/R chip 40 is covered with dielectric material. A second conductive layer 74 is applied to the upper surface 72*a* of fourth dielectric layer 72. Second conductive layer 74 is preferably an ITO layer applied using known techniques. Second conductive layer 74 is etched to form a plurality of non-conductive voids 80 (see FIG. 11) designed to be positioned directly above fifth contact 44*e*. A seventh via 84 is created through fourth dielectric layer 72 directly over fifth contact 44*e* and filled with conductive material to provide an electrical connection between the fifth contact and the open end 86 of the via. A conductive element 87 is disposed upon and is electrically connected to the open end 86 of the seventh via 84. Conductive element 87 increases the conductive surface area of the open end 86 of the seventh via to strengthen the RF coupling capability of seventh via 84. A fifth dielectric layer 88 is applied onto the second conductive layer. A third conductive layer 90 is applied on the fifth dielectric layer and etched to form a radiating element 92. As depicted in FIG. 12, radiating element 92 and second conductive layer 74 (partially depicted) cooperate with fifth contact 44*e* and conductive via 84 to form an active radiating element such as a microstrip antenna element 94. A protective layer or superstrate 96 is applied to the outer surface of the radiating element and is hardened to prevent damage to the antenna element and related circuitry. Protective layer 96 may be made of a substantially transparent dielectric material or an Indium-Tin-oxide (ITO) compound.

Radiating element 92 is capacitively connected to fifth contact 44*e* through fourth dielectric layer 72, and therefore the thickness and dielectric constant of the fourth dielectric layer affect the performance characteristics of the microstrip antenna element.

The foregoing description has described the manufacture of a single antenna element with its associated RF, power and control circuitry. It is believed the described method of manufacture is conducive to the mass production of such antenna elements to form a single ESA using common or interconnected circuitry. An ESA so produced may include thousands or even millions of interconnected, inexpensively-produced antenna elements. In an exemplary embodiment, the conformal ESA can be configured to operate in frequencies of operation used by satellites, such as, Ka frequencies of 17.7 to 20.2 GHz and Ku frequencies of 11.7 to 12.2 GHz. Alternatively, the conformal ESA can be configured to operate at frequencies of operation such as about 4.4 GHz, or at other desired frequencies, although higher frequency applications are best suited to this invention. However, factors relating to the conductive layers such as thickness, surface roughness, and loss of the conductive layers ultimately limit the lower frequency of operation of the ESA, especially if the ESA is desired to be optically transparent. With thin conductive layers, an optically 'transparent' ESA may optimally be used at millimeter-wave, quasi-optical frequencies. When optical transparency is not required, the invention may be used with lower frequency ranges also with the appropriate choice of conductive layer conductivity and thickness. The required conductive layer thickness for low-loss operations is inversely proportional to the operating frequency, i.e., thicker materials are required for lower frequencies. This increase in conductive layer thickness may affect the stiffness, or pliability, of the top-level ESA assembly. Even in situations where the ESA cannot be 'rolled up', the invention still provides a means to create a flexible multi-layer RF substrate with one or more RF robust ground planes suitable for conformal, non-planar platform applications.

As disclosed, microstrip antenna element 94 provides relatively narrowband communication capabilities. If wideband communication capabilities are instead desired, microstrip antenna element 94 may be replaced with a known broadband antenna element design.

Figure 13:
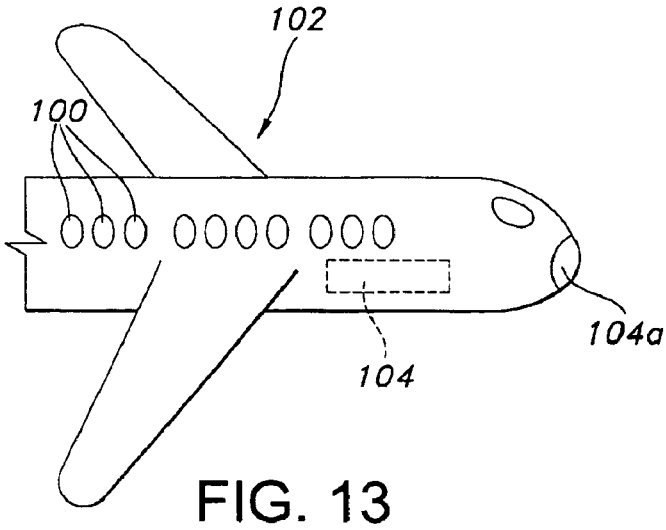
FIG. 13 is a perspective view of a portion of an aircraft, showing possible locations upon which the electronic scanning array of the invention may be disposed.

As previously described, the conformal ESA of the present invention may be applied to an outer surface of a display such that the display and the conformal ESA are integrally formed and deployed. If all elements of the conformal ESA are flexible and transparent (or at least substantially transparent), the conformal ESA will be virtually undetectable by a user of the display. The conformal ESA of the present invention may also be deployed independent of any display. For instance, as shown in FIG. 13, the conformal ESA may be applied to the passenger windows 100 of a vehicle such as an airplane 102. As the conformal ESA is designed to be flexible, it may also be applied to a portion of an outer surface of the vehicle, which may include the fuselage 104 or radome 104*a* if the vehicle is an airplane. The conformal ESA of the present invention may also be incorporated into other devices, such as on the display of a portable hand-held geolocation and/or communications device used by military and civilian users. The invention would also provide a portable or non-portable computer with a high-speed wireless interface. Lastly, the conformal ESA of the present invention may further be used with a flexible display to provide an integrated, flexible communications/display solution.

Figure 14:
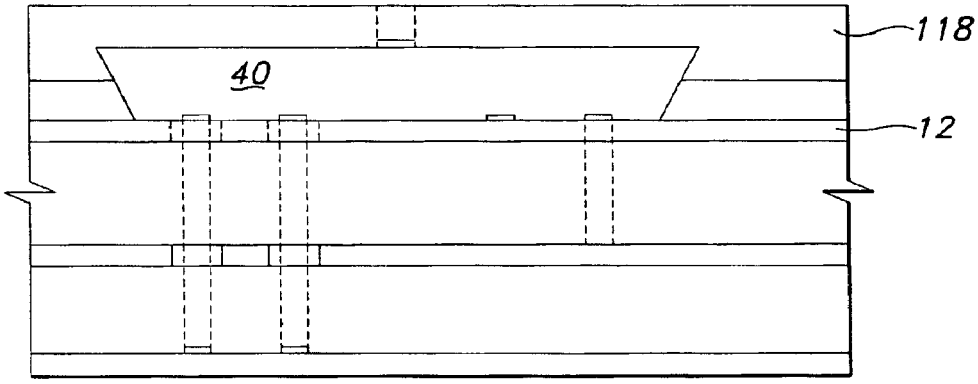
FIG. 14 is a side elevational view of a portion of a single element of a conformal electronic scanning, array according to another embodiment of the invention.
Figure 15:
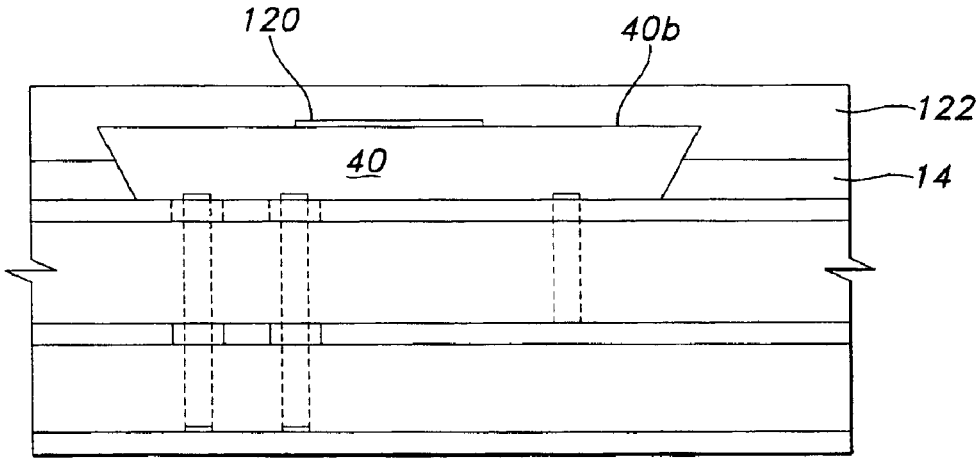
FIG. 15 is a side elevational view of a portion of a single element of a conformal electronic scanning array according to still another embodiment of the invention.
Figure 16:
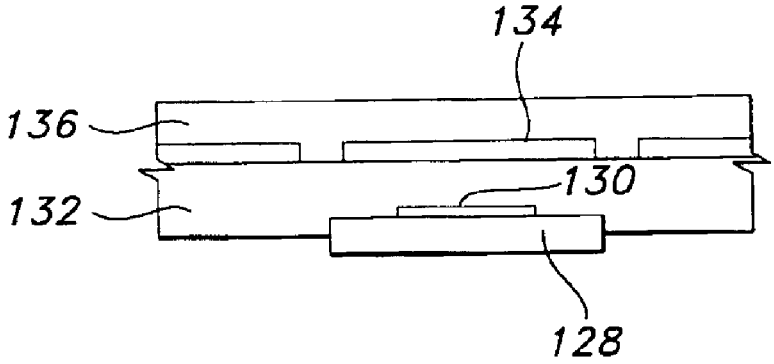
FIG. 16 is a side elevational view of a single element of a conformal electronic scanning array according to yet another embodiment of the invention.

The invention may be varied in many ways. For example, FIG. 14 shows a portion of an ESA according to another embodiment of the invention in which receiving depression 30 is created so that T/R chip 40, when disposed therein, substantially contacts RF manifold layer 12. As with the previous embodiment, a dielectric layer 118 is applied to the upper surface of the T/R chip, and further layers are applied to create the desired antenna element. This embodiment reduces the number of vias to be created. FIG. 15 shows another embodiment in which a radiating element 120 is integrated onto upper surface 40*b* of T/R chip 40. A superstrate layer 122 is deposited or applied directly on dielectric layer 14 to encapsulate and protect T/R chip 40 and radiating element 120. This embodiment is applicable only to frequencies of operation high enough that the T/R chip size is a large fraction of a waveguide, which is required for radiating element efficiency. FIG. 16 shows still another embodiment of the invention in which an RF contact 130 on a T/R chip 128 is large enough, relative to its respective radiating element 134, to function as an RF coupling mechanism at certain frequencies. A dielectric layer 132 separates the RF contact from the radiating element, and a superstrate layer 136 is applied the structure as previously disclosed.

Figure 17:
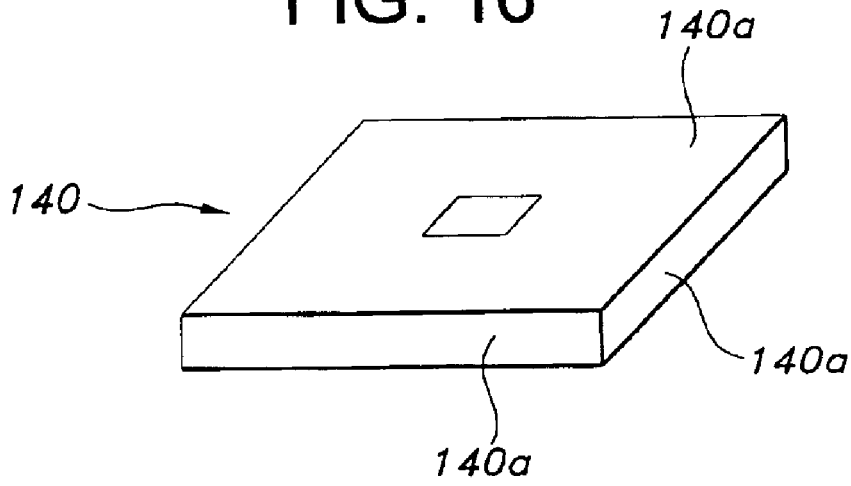
FIG. 17 is a perspective view of a transmit/receive chip according to another embodiment of the invention.
Figure 18:
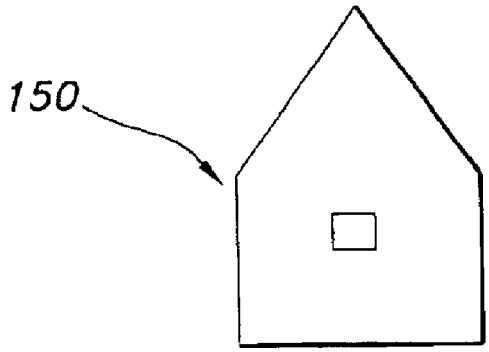
FIG. 18 is a top plan view of another embodiment of a transmit/receive chip according to another embodiment of the invention.

Previous embodiments have shown a T/R chip with angled or chamfered sides 40*c*, but the crystalline structure of the material from which the T/R chip is made may make it difficult to form such angled sides without cleaving of the material. FIG. 17 shows a T/R chip 140 that may be used with any of the previously disclosed embodiments of the invention. T/R chip 140 is a regular rectangular prism, with all surfaces 140*a* orthogonal to respective adjacent surfaces. The receiving depression into which T/R chip 140 fits would have a complementary rectangular shape as well, instead of the previously disclosed trapezoidal shape. FIG. 18 shows a top view of another embodiment of a T/R chip 150, having a distinctive shape, such as an irregular pentagon, that ensures the T/R chip has a unique orientation when placed or fitted into a correspondingly shaped receiving depression. In such an embodiment there would be no need for redundant sets of contacts on the T/R chip because the T/R chip could fit into the correspondingly shaped only in the proper orientation.

The sequence and timing at which the vias are created may also be varied as desired. For example, third via 32 and first via 22 may be formed at the same time if desired. Vias may also be created outside of receiving depression 30, with a conductive layer placed upon the first dielectric layer and etched to electrically connect the vias with contacts on the T/R chip. It is also possible to place fourth contact 44*d* on upper surface 40*b* of the T/R chip and connect the fourth contact to a conductive ground plane deposited upon first dielectric layer. Other variations are also possible and are within the scope of the invention as claimed.

Thus, it can be seen that the invention provides a communications antenna that may be used in many different applications. An advantage of the invention is that it may be deployed on an outer surface of a display, thereby eliminating the need for a separate antenna.

Another advantage is that the invention may be made using rolled manufacturing techniques similar to the techniques used in creating known LCD displays. This means that the invention may be easily produced at a fraction of the cost of previously developed, labor intensive phased array antennas.

Another advantage is, that the invention may be applied to curved surfaces, such as the outer surface of a vehicle.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novels and non-obvious. Inventions embodied in other combinations and subcombinations of features, functions, elements and/or properties may be claimed through amendment of the present claims or presentation of new claims in this application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A method of forming a conformal electronic scanning array, the method comprising:

providing a substrate;

establishing a plurality of receptor structures in the substrate;

creating a first conductive passage, associated with each receptor structure, through the substrate;

applying a plurality of transmit/receive circuitry units to a surface of the substrate such that each of a substantial portion of the receptor structures are filled by a transmit/receive circuitry unit disposed therein, wherein a first electrical contact on each transmit/receive circuitry unit is positioned to be electrically connected with the first conductive passage;

applying a first dielectric layer to the substrate;

applying a first conductive layer to the first dielectric layer;

applying a second dielectric layer to the first conductive layer;

applying a second conductive layer to the second dielectric layer; and etching the second conductive layer to form a plurality of radiating elements, each of the plurality of radiating elements being disposed adjacent one of the plurality of transmit/receive circuitry units such that a radiating element, a second contact on a transmit/receive circuitry unit, and the first conductive layer, cooperate to form an active radiating element controlled by the transmit/receive circuitry unit.

2. The method of claim 1, further comprising:

applying a protective layer on the plurality of radiating elements.

3. The method of claim 1, wherein the substrate, the first dielectric layer, the second dielectric layer are substantially transparent.

4. The method of claim 3, wherein the substrate is operationally attached to a display element configured to be viewed through the substrate, the first dielectric layer, the second dielectric layer.

5. The method of claim 1, wherein creating the first conductive passages is at least partially accomplished using a laser.

6. The method of claim 1, further comprising providing each of the plurality of transmit/receive circuitry units with a first set of contacts and a second set of contacts, wherein each of the contacts in the first set of contacts is configured to be connected to an electrical connection when its respective transmit/receive circuitry unit is positioned in a receptor structure in a first orientation, and further wherein each of the contacts in the second set of contacts is configured to be connected to an electrical connection when its respective transmit/receive circuitry unit is positioned in the receptor structure in a second orientation.

7. The method of claim 1, wherein the surface of the substrate is a first surface, the method further comprising:

applying a conductive RF manifold layer to a second surface of the substrate;

forming a plurality of RF contacts from the RF manifold layer, each RF contact being aligned with one of the first conductive passages such that the first contact on each transmit/receive circuitry unit is electrically connected, through a first conductive passage, to one of the RF contacts.

8. The method of claim 7, wherein each transmit/receive circuitry unit includes a power contact and a control contact thereon, and further comprising:

creating a second conductive passage and a third conductive passage, within each receptor structure, through the substrate;

connecting the power contact, through the second conductive passage, to a first connection on a conductive power/control manifold layer to thereby provide power to the transmit/receive circuitry unit; and connecting the control contact, through the third conductive passage, to a second connection on the conductive power/control manifold layer to thereby provide control signals to the transmit/receive circuitry unit.

9. A conformal electronic scanning array, comprising:

a substrate having a first surface and a second surface;

a plurality of receptor structures formed in the substrate;

a plurality of vias formed in each receptor structure, through the substrate;

a plurality of transmit/receive circuitry units applied to the first conductive layer and operative to fit into any of the plurality of receptor structures, wherein each of the transmit/receive circuitry units have a plurality of electrical contacts disposed thereon, and further wherein each of the transmit/receive circuitry units are configured to accommodate at least one of sending and receiving electronic communications;

wherein the plurality of vias are configured to be aligned with a corresponding number of electrical contacts disposed upon a transmit/receive circuitry unit that fits into the respective receptor structure to provide at least one of a power input and a control input to the transmit/receive circuitry unit;

an antenna element operationally connected to the transmit/receive circuitry unit.

10. The conformal electronic scanning array of claim 9, further including:

a first dielectric layer applied on the transmit/receive circuitry units;

a first conductive layer applied on the first dielectric layer and etched to form a plurality of non-conductive voids;

a second dielectric layer applied on the first conductive layer and configured to fill the plurality of non-conductive voids;

a second conductive layer applied to the second dielectric layer and etched to form a plurality of radiating elements, wherein each of the radiating elements is associated with an RF contact on one of the transmit/receive circuitry units to form the antenna element therewith.

11. The conformal electronic scanning array of claim 10, wherein the substrate, the first dielectric layer, the second dielectric layers is substantially transparent.

12. The conformal electronic scanning array of claim 9, wherein the substrate is formed of one of a dielectric material and a semiconductor material.

13. The conformal electronic scanning array of claim 9, wherein each of the receptor structures and transmit/receive circuitry unit have a complementary topology that permits each of the transmit/receive circuitry unit to fit into a respective receptor structure only when the transmit/receive circuitry unit is oriented in one or more predetermined directions with respect to the respective receptor structure.

14. The conformal electronic scanning array of claim 10, wherein the substrate, the first dielectric layer, the second dielectric layer cooperate to form a flexible, bendable structure.

15. The conformal electronic scanning array of claim 9, further comprising:

a first conductive manifold layer applied to the second surface of the substrate, the first conductive manifold layer being etched to form thereupon an RF connection that is electrically connected, through one of the plurality of vias, to a second RF contact on the transmit/receive circuitry unit, to thereby provide a means of sending and receiving RF signals to and from the antenna element.

16. The conformal electronic scanning array of claim 15, wherein the electrical contacts disposed upon each transmit/receive circuitry unit include a power contact and a control contact, the invention further comprising:

a third dielectric layer applied to the first conductive manifold layer; and a second conductive manifold layer that is etched to form thereupon a control connection that is electrically connected, through one of the plurality of vias, to the control contact on the transmit/receive circuitry unit to provide a control input thereto, and a power connection that is electrically connected, through one of the plurality of vias, to the power contact on the transmit/receive circuitry unit to provide a power input thereto.

17. The conformal electronic scanning array of claim 16, further including:

a conductive ground plane layer disposed upon the third dielectric layer;

a fourth dielectric layer disposed upon the conductive ground plane layer, wherein the second conductive manifold layer is applied to the fourth dielectric layer;

wherein the conductive ground plane layer electromagnetically isolates the first conductive manifold layer from the second conductive manifold layer.

18. An electronics device including a display component and a conformal electronic scanning array secured to a viewable surface of the display component between the display and a viewer, and wherein the conformal electronic scanning array comprises:

a substrate having a first surface and a second surface;

a plurality of receptor structures formed in the first surface of the substrate;

a plurality of vias formed in each receptor structure, through the substrate;

a plurality of transmit/receive circuitry units applied, in a slurry, to the first surface of the substrate and operative to fit into any of the plurality of receptor structures, wherein each of the transmit/receive circuitry units have a plurality of electrical contacts disposed thereon;

wherein the plurality of vias are aligned with a corresponding number of electrical contacts disposed upon a transmit/receive circuitry unit when said circuitry unit is set in a receptor structure, so that the plurality of vias provide at least one of a power input and a control input to said circuitry unit;

a first dielectric layer applied on the transmit/receive circuitry units;

a first conductive layer applied on the first dielectric layer;

a second dielectric layer applied on the first conductive layer;

a second conductive layer applied to the second dielectric layer and etched to form a plurality of radiating elements, wherein each of the radiating elements is associated with an RF contact on one of the transmit/receive circuitry units to form an active radiating element therewith;

wherein the substrate, the first dielectric layer, the second dielectric layer substantially transparent.

19. The communications device of claim 18, wherein the display component is one of a computer screen and an LCD display.

20. The conformal electronic scanning array of claim 18, wherein the substrate, the first dielectric layer, the second dielectric layer cooperate to form a flexible, bendable structure.

* * * * *